US010571150B2

(12) United States Patent
Vie et al.

(10) Patent No.: US 10,571,150 B2
(45) Date of Patent: Feb. 25, 2020

(54) HVAC CONTROL ASSEMBLIES, AND CORRESPONDING METHODS OF DETERMINING EQUIPMENT WIRING HARNESS CONNECTIONS

(71) Applicant: Emerson Electric Co., St. Louis, MO (US)

(72) Inventors: David L. Vie, Union, MO (US); Thomas Blizzard, Imperial, MO (US); Amanda Diaz, Oklahoma City, OK (US)

(73) Assignee: EMERSON ELECTRIC CO., St. Louis, MO (US)

( * ) Notice: Subject to any disclaimer, the term of this patent is extended or adjusted under 35 U.S.C. 154(b) by 172 days.

(21) Appl. No.: 15/596,245

(22) Filed: May 16, 2017

(65) Prior Publication Data

US 2018/0335225 A1 Nov. 22, 2018

(51) Int. Cl.
*F24F 11/89* (2018.01)
*F24F 11/88* (2018.01)
*F24F 11/61* (2018.01)

(52) U.S. Cl.
CPC ..... *F24F 11/89* (2018.01); *F24F 11/88* (2018.01); *F24F 11/61* (2018.01)

(58) Field of Classification Search
CPC ..... F24F 11/89; H01R 12/7076
USPC ..... 174/260; 361/760
See application file for complete search history.

(56) References Cited

U.S. PATENT DOCUMENTS

| | | | | |
|---|---|---|---|---|
| 7,329,834 | B2 | 2/2008 | Kaufman et al. | |
| 2010/0035461 | A1* | 2/2010 | Berke | H01R 13/641 439/489 |
| 2010/0084482 | A1* | 4/2010 | Kennedy | F24F 11/30 236/51 |
| 2016/0123588 | A1* | 5/2016 | Vie | F23N 5/242 431/18 |
| 2017/0286351 | A1* | 10/2017 | Williams | H04L 12/40 |

* cited by examiner

*Primary Examiner* — Christopher R Zerphey
*Assistant Examiner* — Schyler S Sanks
(74) *Attorney, Agent, or Firm* — Harness, Dickey & Pierce, P.L.C.; Anthony G. Fussner

(57) ABSTRACT

Exemplary embodiments are provided of HVAC control assemblies. In an exemplary embodiment, an HVAC control assembly includes an HVAC control board, a first interface connector, and a second interface connector. The first interface connector and the second interface connector each include multiple pins adapted for connection to an equipment wiring harness. The assembly also includes an electrical conductor connected between at least one of the multiple pins of the first interface connector and at least one of the multiple pins of the second interface connector, and an HVAC controller configured to determine whether an equipment wiring harness is connected to the first interface connector or the second interface connector based on a state of at least one of the multiple pins connected to the electrical conductor. Example methods of determining an equipment wiring harness connection in an HVAC control assembly are also disclosed.

20 Claims, 4 Drawing Sheets

HVAC CONTROL ASSEMBLIES, AND CORRESPONDING METHODS OF DETERMINING EQUIPMENT WIRING HARNESS CONNECTIONS

FIELD

The present disclosure generally relates to HVAC control assemblies, and corresponding methods of determining equipment wiring harness connections in HVAC control assemblies.

BACKGROUND

This section provides background information related to the present disclosure which is not necessarily prior art.

Universal service heating, ventilation and air-conditioning (HVAC) control boards are used to control furnaces, air handlers, heat pumps, and air-conditioning units. Properly configuring most universal service HVAC control boards to match their original application generally requires manual intervention by an installer.

DRAWINGS

The drawings described herein are for illustrative purposes only of selected embodiments and not all possible implementations, and are not intended to limit the scope of the present disclosure.

DETAILED DESCRIPTION

Example embodiments will now be described more fully with reference to the accompanying drawings.

The inventors herein have recognized that properly configuring most universal service HVAC control boards (e.g., furnace control boards, air handler control boards, heat pump control boards, air-conditioning control boards, etc.) to match their original application can require manual intervention by an installer. Many control boards include dipswitches, jumpers, push-buttons, etc., for configuring certain control parameters (e.g., blower time delays, etc.), or selecting the original equipment manufacturer (OEM) brand the board is installed with, so that additional software timings, etc., and other features are correctly set.

The inventors have also recognized that dipswitches, etc. may be incorrectly set by an installer through human error, the installer may simply forget to set a feature, etc. This may result in improper operation of a unit, a return service call, etc.

Described herein are exemplary embodiments of HVAC control assemblies including HVAC control boards having more than one main system interface connector. The control board is therefore able to detect which connector is coupled to an equipment wiring harness during installation, and may automatically set certain features and functionality without installer intervention.

The HVAC controller may automatically detect the application in which the HVAC control board is being used (e.g., a CARRIER furnace, other HVAC system, etc.). If the HVAC controller detects a low (e.g., grounded, etc.) input pin (e.g., pin nine of an inline header interface connector, etc.), the HVAC system may automatically configure for a specific OEM (e.g., CARRIER, etc.) application. If the HVAC controller detects a high input at the indicator pin, the HVAC controller may automatically configure for settings according to other OEM applications, etc. Example settings may affect housing pressure sense sensing, fault handling, etc.

Examples of automatic equipment wiring harness detection and subsequent control parameter configuration, as described herein, can facilitate proper setting of certain control attributes, simplify and streamline the installation process for the installer, facilitate correct system operation and safety, etc.

Figure 1:
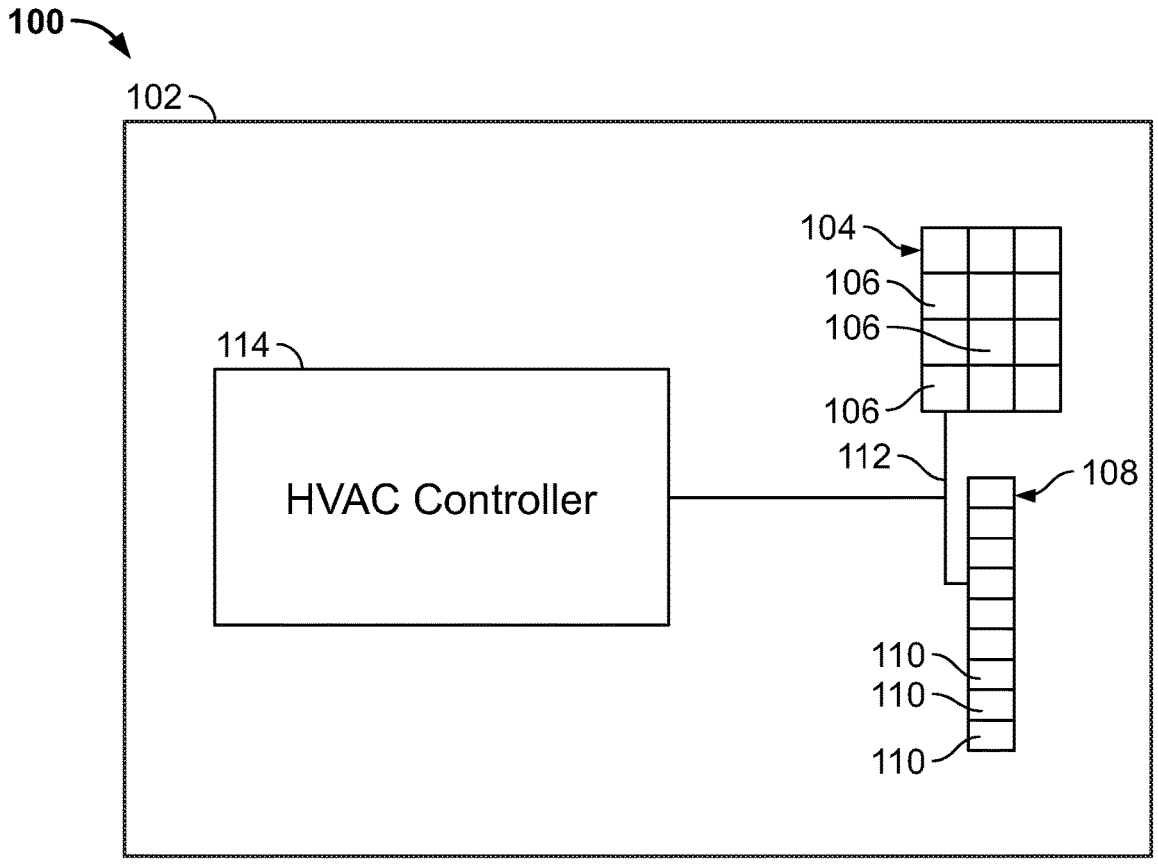
FIG. 1 is a block diagram of an HVAC control assembly according to one exemplary embodiment of the present disclosure.

FIG. 1 illustrates an exemplary embodiment of an HVAC control assembly 100 having an HVAC control board 102 (e.g., a circuit board, a printed circuit board (PCB), etc.).

A first interface connector 104 is disposed on the HVAC control board 102. The first interface connector 104 includes multiple pins 106 adapted for connection to an equipment wiring harness when the equipment wiring harness is coupled to the first interface connector 104.

A second interface connector 108 is disposed on the HVAC control board 102. The second interface connector 108 includes multiple pins 110 adapted for connection to the equipment wiring harness when the equipment wiring harness is coupled to the second interface connector 108.

An electrical conductor 112 is connected between at least one of the multiple pins 106 of the first interface connector 104 and at least one of the multiple pins 110 of the second interface connector 108. An HVAC controller 114 is configured to determine whether an equipment wiring harness is connected to the first interface connector 104 or the second interface connector 108 based on a state of at least one of the multiple pins 106 and/or 110 connected to the electrical conductor 112.

As shown in FIG. 1, the first interface connector 104 includes twelve pins 106. The twelve pins 106 are arranged in a 3×4 arrangement (e.g., three rows of four pins each, a 3×4 AMP mate connector, etc.). Therefore, the first interface connector 104 is adapted to couple to equipment wiring harnesses having a similar twelve pin connector (e.g., in a 3×4 arrangement, etc.).

The second interface connector 108 includes nine pins 110. The nine pins 110 are arranged in an inline header arrangement (e.g., a CARRIER nine pin AMP connector, etc.). Therefore, the second interface connector 108 is adapted to couple to equipment wiring harnesses having a similar nine pin connector (e.g., in an inline header arrangement, etc.).

Although FIG. 1 illustrates the first interface connector 104 as having twelve pins 106 in a 3×4 arrangement and the second interface connector 108 as having nine pins in an inline header arrangement, it should be apparent that other embodiments may include other suitable interface connectors. For example, the interface connectors could have more or less than twelve and nine pins each (e.g., eleven pins, etc.), the interface connectors could have different pin arrangements (e.g., other than a 3×4 and an inline header arrangement, etc.), the interface connectors could have the same number of pins (e.g., in different arrangements, etc.), the HVAC control board 102 could have more than two interface connectors, etc.

The equipment wiring harness coupled to the first interface connector 104 or the second interface connector 108 can be any suitable equipment wiring harness for coupling to one or more components of an HVAC system to the HVAC control board 102, to allow the HVAC control board 102 to control the components. For example, the equipment wiring harness may be coupled to a gas valve, an inducer, a circulator, a blower, etc.

The number of pins of the equipment wiring harness (and optionally the shape of the pins of the equipment wiring harness) may correspond to different equipment original equipment manufacturers (OEMs) of the HVAC system components. For example, different manufacturers may use different equipment wiring harnesses that connect to different interface connectors on an HVAC control board (e.g., a twelve pin connector, a nine pin connector, a 3×4 arrangement, an inline header arrangement, etc.).

The HVAC controller 114 may be configured to detect a type of original equipment manufacturer system, component(s), etc., connected to the HVAC control board 102, based on the type of equipment wiring harness coupled to the HVAC control board 102. Because different OEM systems, component(s), etc., may use different control settings, the HVAC controller 114 may set different control parameters based on the determined type of equipment wiring harness connected to the HVAC control board 102.

For example, the HVAC controller 114 may be configured to set at least one control parameter based on the determination of whether the equipment wiring harness is connected to the first interface connector 104 or the second interface connector 108. As mentioned above, different equipment manufacturers may use different equipment wiring harness connectors. If the HVAC controller 114 determines the equipment wiring harness is coupled to the first interface connector 104, the HVAC controller 114 may determine the connected HVAC system, component(s), etc., belongs to an OEM using a twelve pin connector in a 3×4 arrangement.

Similarly, if the HVAC controller 114 determines the equipment wiring harness is coupled to the second interface connector 108, the HVAC controller 114 may determine the connected HVAC system, component(s), etc., belongs to an OEM using a nine pin connector in an inline header arrangement.

Based on the determination, the HVAC controller 114 may set an appropriate control parameter for the equipment wiring harness. For example, the HVAC controller 114 may set a blower time delay, another OEM setting corresponding to the detected OEM type, etc. In this manner, the HVAC controller 114 can automatically select certain parameters for operation as a function of the detected wiring harness connection.

As mentioned above, an electrical conductor 112 is connected between at least one of the multiple pins 106 of the first interface connector 104 and at least one of the multiple pins 110 of the second interface connector 108. The HVAC controller 114 is configured to determine whether an equipment wiring harness is connected to the first interface connector 104 or the second interface connector 108 based on a state of at least one of the multiple pins 106 and/or 110 connected to the electrical conductor 112.

In some embodiments, at least one of the multiple pins 106 and/or 110 connected to the electrical conductor 112 may be an indicator pin. For example, the electrical conductor 112 may be coupled to connect the indicator pin to ground when an equipment wiring harness is coupled to the first interface connector 104. The electrical conductor 112 may be coupled to disconnect the indicator pin from ground when the equipment wiring harness is coupled to the second interface connector 108.

In this manner, the electrical conductor 112 connects pin(s) of each interface connector 104, 108 in common, which allows for the state of the indicator pin to change when an equipment wiring harness is coupled to one or the other of the interface connectors 104 and 108.

Therefore, the HVAC controller 114 may be configured to determine whether a wiring harness is connected to the first interface connector 104 or the second interface connector 108 based on a state of the indicator pin. As an example, one OEM manufacturer (e.g., CARRIER, etc.) may use a nine pin header equipment wiring harness, and have two pressure switches on its single stage furnace. As a result, an installer of an aftermarket control must remember to take the extra pressure switch into account when setting up the control for use in such a furnace. However, other furnaces made by other manufacturers may not have this issue. The extra pressure switch can also determine certain error codes that are not present in the furnace controllers of other manufacturers.

The HVAC controller 114 described herein can auto-configure, etc., the appropriate parameters, to address this technical problem. For example, the common electrical conductor 112 between pins of the two interface connectors 104, 108 can connect one of the pins to ground when a wiring harness is connected to the second interface connector 108, to indicate the equipment wiring harness belongs to a specific OEM (e.g., CARRIER, etc.). This input to the HVAC controller 114 can indicate to the HVAC controller 114 that it is controlling a single stage furnace belonging to the specific OEM, and the HVAC controller can select appropriate parameters for the specific OEM based on the low (e.g., grounded, etc.) signal from the electrical conductor 112 coupled to the indicator pin.

When the equipment wiring harness is coupled to the first interface controller 104, the electrical conductor 112 will drive the indicator pin high (e.g., disconnected from ground, etc.), which will indicate to the HVAC controller 114 that it is not controlling a furnace belonging to the specific OEM.

The HVAC controller 114 may be configured to perform operations using any suitable combination of hardware and software. For example, the HVAC controller 114 may include any suitable circuitry, logic gates, microprocessor(s), computer-executable instructions stored in memory, etc., operable to cause the HVAC controller 114 to perform actions described herein (e.g., determining whether an equipment wiring harness is coupled to the first interface connector 104 or the second interface connector 108, etc.).

Figure 2:
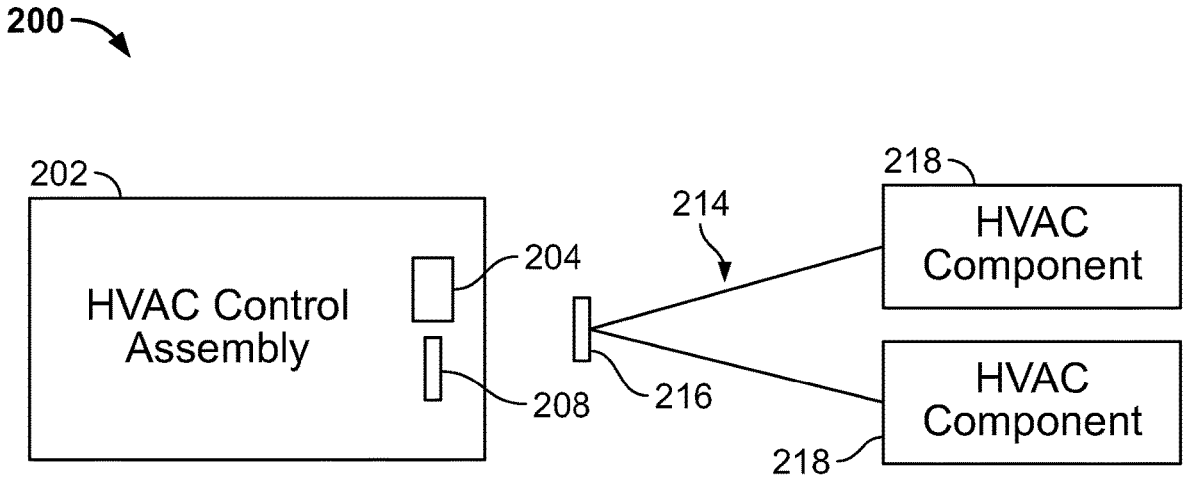
FIG. 2 is a diagram of an HVAC system including the HVAC control assembly of FIG. 1.

FIG. 2 illustrates an example embodiment of an HVAC system 200 having an HVAC control assembly 202. The HVAC control assembly 202 includes a first interface connector 204, and a second interface connector 208.

The HVAC system 200 also includes an equipment wiring harness 214. The equipment wiring harness 214 is connected to two HVAC components 218.

The equipment wiring harness 214 includes a harness connector 216 that may be coupled to one of the first interface connector 204 and the second interface connector 208 of the HVAC control assembly 202. This allows the HVAC control assembly 202 to control the HVAC components 218 via the equipment wiring harness 214.

Figure 3:
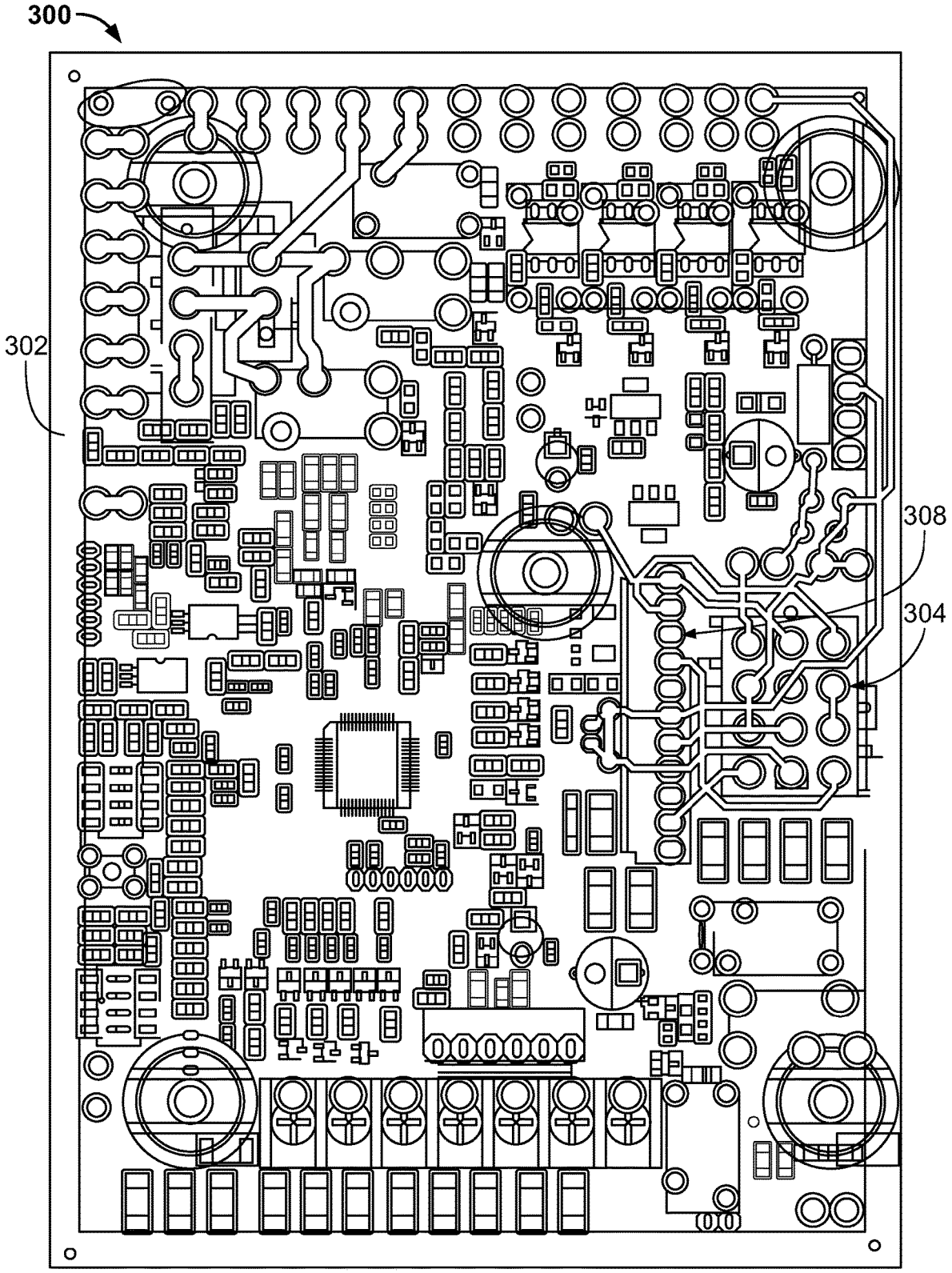
FIG. 3 is a circuit diagram of an HVAC control assembly according to another exemplary embodiment of the present disclosure.

FIG. 3 illustrates another exemplary embodiment of an HVAC control assembly 300. As shown in FIG. 3, the HVAC control assembly includes an HVAC control board 302 having a first interface connector 304 and a second interface connector 308.

The first interface connector 304 includes twelve pins in a 3×4 arrangement. The second interface connector 308 includes eleven pins in an inline header arrangement. Multiple pins of the two interface connectors 304, 308 are connected by common electrical conductor wires.

Figure 4:
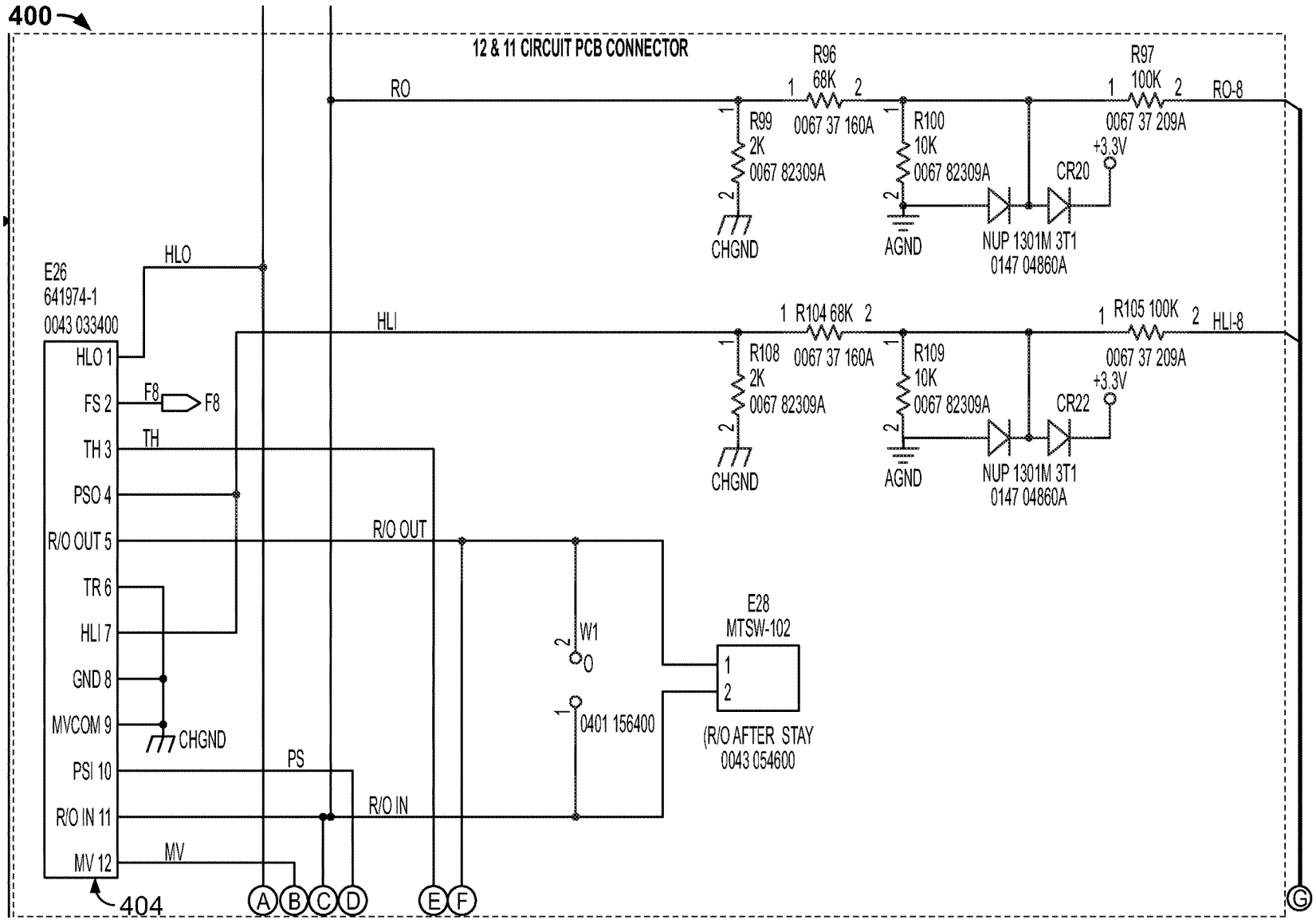
FIG. 4 is a wiring schematic of an HVAC control assembly according to another exemplary embodiment of the present disclosure.
Figure 4:
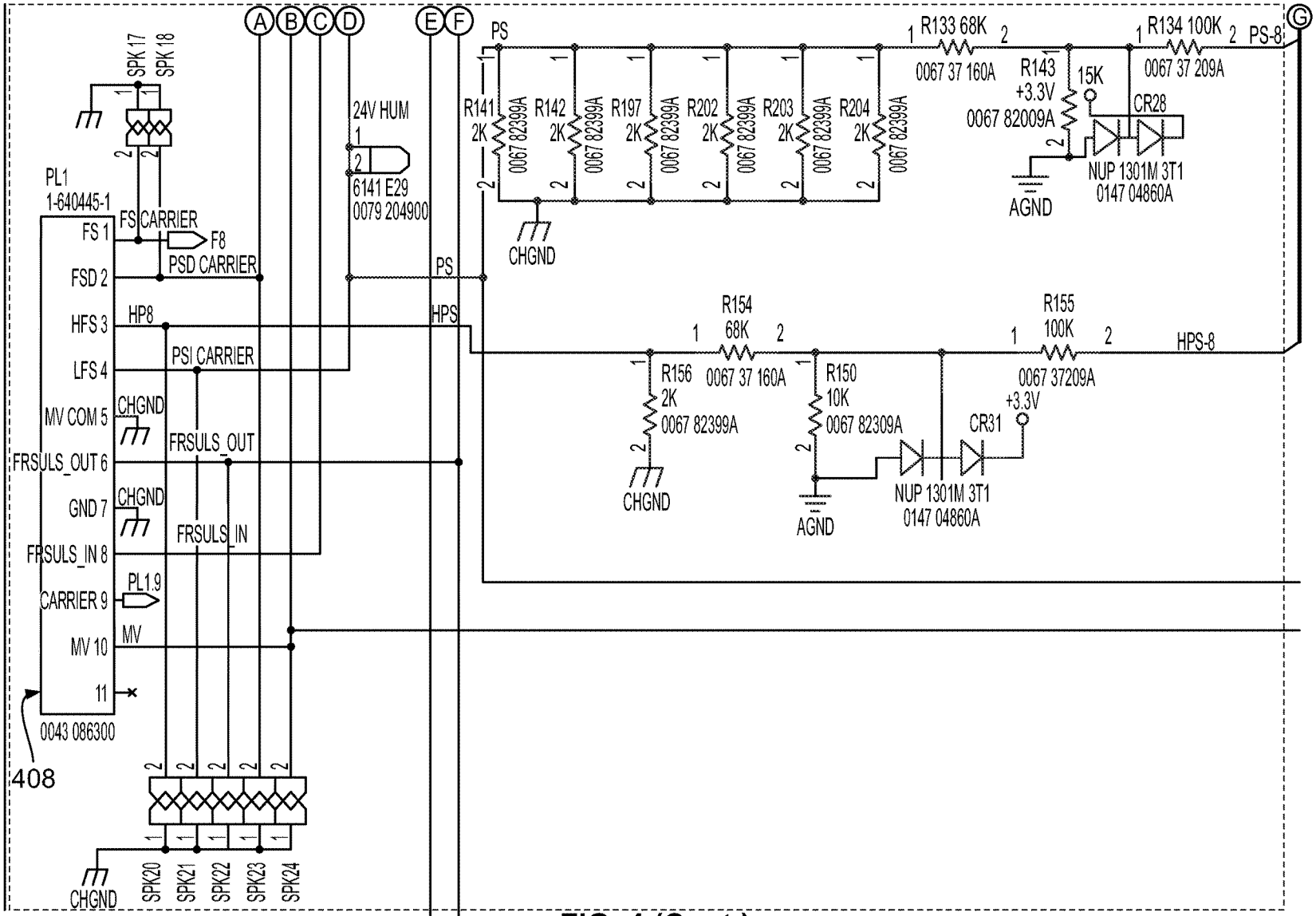

FIG. 4 illustrates another exemplary embodiment of an HVAC control assembly 400. As shown in FIG. 4, the HVAC control assembly includes a first interface connector 404 and a second interface connector 408.

The first interface connector 404 includes twelve pins, and the second interface connector 408 includes eleven pins. As illustrated in FIG. 4, multiple pins of the first interface connector 404 and the second interface connector 408 are coupled via common electrical conductor wires.

The example HVAC control assemblies described herein may be included in any suitable HVAC system, etc. For example, the HVAC control boards described herein may include furnace control boards, air handler control boards, heat pump control boards, air-conditioning control boards.

The HVAC control boards may include aftermarket control boards capable of replacing existing control boards from one of multiple different original equipment manufacturer HVAC systems. For example, the HVAC control board may typically be fully populated so that an HVAC contractor can carry one replacement part for multiple furnace types.

In some embodiments, the HVAC controllers described herein may be furnace controllers (e.g., a single stage furnace control, an integrated furnace control, etc.), other suitable HVAC system controllers, etc.

According to another example embodiment of the present disclosure, a method of determining an equipment wiring harness connection in an HVAC control assembly is disclosed. The HVAC control assembly includes an HVAC control board, a first interface connector disposed on the HVAC control board and having multiple pins, a second interface connector disposed on the HVAC control board and having multiple pins, and an electrical conductor connected between at least one of the multiple pins of the first interface connector and at least one of the multiple pins of the second interface connector.

The exemplary method includes detecting a state of at least one of the multiple pins connected to the electrical conductor, and determining whether an equipment wiring harness is connected to the first interface connector or the second interface connector based on the detected state of the at least one of the multiple pins connected to the electrical conductor.

The method may include setting at least one control parameter based on the determination of whether the equipment wiring harness is connected to the first interface connector or the second interface connector. For example, the control parameter may include a blower time delay of an original equipment manufacturer (OEM) setting corresponding to the detected equipment wiring harness, etc.

In some embodiments, a total number of the multiple pins of the first interface connector is different than a total number of the multiple pins of the second interface connector. The first interface connector may include a total of nine pins, and the second interface connector may include a total of twelve pins. As should be apparent, other embodiments may include interface connectors having any other suitable number of pins.

The example embodiments described herein include HVAC control assemblies having HVAC control boards including more than one interface connector. The control board is therefore able to detect which interface connector is coupled to an equipment wiring harness during installation, and may automatically set certain features and functionality without installer intervention. The example automatic equipment wiring harness detection and subsequent control parameter configuration, as described herein, can facilitate proper setting of certain control attributes, simplify and streamline the installation process for the installer, facilitate correct system operation and safety, etc.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "includes," "including," "has," "have," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An HVAC control assembly comprising:

an HVAC control board;

a first interface connector disposed on the HVAC control board, the first interface connector having multiple pins adapted for connection to a first equipment wiring harness when the first equipment wiring harness is coupled to the first interface connector;

a second interface connector disposed on the HVAC control board, the second interface connector having multiple pins adapted for connection to a second equipment wiring harness when the second equipment wiring harness is coupled to the second interface connector;

an electrical conductor connected between at least one of the multiple pins of the first interface connector and at least one of the multiple pins of the second interface connector, wherein said at least one of the multiple pins of the first interface connector connected with the electrical conductor includes an indicator pin, the electrical conductor and the indicator pin are coupled to electrical ground when the first equipment wiring harness is coupled to the first interface connector, and the electrical conductor and indicator pin are not connected to electrical ground when the second equipment wiring harness is coupled to the second interface connector; and an HVAC controller configured to determine that the first equipment wiring harness is connected to the first interface connector when said indicator pin is detected as connected to electrical ground, and to determine that the second equipment wiring harness is connected to the second interface connector in response to detecting that said indicator pin is not connected to electrical ground.

2. The HVAC control assembly of claim 1, wherein the HVAC controller is configured to set at least one control parameter based on the determination of whether the first equipment wiring harness is connected to the first interface connector or the second equipment wiring harness is connected to the second interface connector.

3. The HVAC control assembly of claim 2, wherein the at least one control parameter includes a blower time delay of an original equipment manufacturer (OEM) setting.

4. The HVAC control assembly of claim 1, further comprising the first or second equipment wiring harness coupled to the corresponding one of the first interface connector and the second interface connector, the first or second equipment wiring harness connected to at least one of a gas valve, an inducer, and a circulator.

5. The HVAC control assembly of claim 1, wherein a total number of the multiple pins of the first interface connector is different than a total number of the multiple pins of the second interface connector.

6. The HVAC control assembly of claim 5, wherein the multiple pins of the first interface connector include a total of nine pins.

7. The HVAC control assembly of claim 6, wherein the nine pins are positioned in an inline header interface connector arrangement.

8. The HVAC control assembly of claim 5, wherein the multiple pins of the second interface connector include a total of twelve pins.

9. The HVAC control assembly of claim 8, wherein the twelve pins are positioned in a 3×4 interface connector arrangement having three rows of four pins each.

10. The HVAC control assembly of claim 1, wherein the HVAC controller comprises a single stage furnace control.

11. The HVAC control assembly of claim 1, wherein the HVAC control board comprises at least one of a furnace control board, an air handler control board, a heat pump control board, and an air-conditioning control board.

12. The HVAC control assembly of claim 11, wherein the HVAC control board comprises an aftermarket control board capable of replacing an existing control board in multiple different original equipment manufacturer HVAC systems.

13. An HVAC system including the HVAC control assembly of claim 1.

14. A method of determining a first or second equipment wiring harness connection in an HVAC control assembly, the HVAC control assembly including an HVAC control board, a first interface connector disposed on the HVAC control board and having multiple pins, a second interface connector disposed on the HVAC control board and having multiple pins, and an electrical conductor connected between at least one of the multiple pins of the first interface connector and at least one of the multiple pins of the second interface connector, the method comprising:

detecting that the at least one of the multiple pins of the first interface connector connected to the electrical conductor is connected to electrical ground when the first equipment wiring harness is coupled to the first interface connector;

detecting that the at least one of the multiple pins of the first interface connector connected to the electrical conductor is not connected to electrical ground when the second equipment wiring harness is coupled to the second interface connector; and determining that the second equipment wiring harness is connected to the second interface connector in response to detecting that the at least one of the multiple pins of the first interface connector is not connected to electrical ground.

15. The method of claim 14, further comprising setting at least one control parameter based on the determination of whether the corresponding first or second equipment wiring harness is connected to the first interface connector or the second interface connector.

16. The method of claim 15, wherein the at least one control parameter includes a blower time delay of an original equipment manufacturer (OEM) setting.

17. The method of claim 14, wherein a total number of the multiple pins of the first interface connector is different than a total number of the multiple pins of the second interface connector.

18. The method of claim 17, wherein the multiple pins of the first interface connector includes a total of nine pins, and the multiple pins of the second interface connector include a total of twelve pins.

19. The method of claim 18, wherein the nine pins of the first interface connector are positioned in an inline header interface connector arrangement.

20. The method of claim 18, wherein the twelve pins of the second interface connector are positioned in 3×4 interface connector arrangement having three rows of four pins each.

* * * * *